United States Patent [19]

Hope et al.

[11] 4,118,150

[45] Oct. 3, 1978

[54] CONTROL APPARATUS RESPONSIVE TO LIQUID FLOW

[76] Inventors: Henry F. Hope, 2421 Wyandotte Rd.; Stephen F. Hope, both of Willow Grove, Pa. 19090

[21] Appl. No.: 829,288

[22] Filed: Aug. 31, 1977

[51] Int. Cl.[2] ..... F04B 49/02

[52] U.S. Cl. ..... 417/40; 73/219

[58] Field of Search ..... 417/36, 40; 73/306, 73/319, 315, 320, 322.5; 200/84 C

[56] References Cited

U.S. PATENT DOCUMENTS

| | | | |
|---|---|---|---|
| 2,949,126 | 8/1960 | Kuntz et al. | 417/40 X |
| 2,955,173 | 10/1960 | Kranz | 417/40 X |
| 3,091,184 | 5/1963 | Wood | 417/40 |
| 3,149,571 | 9/1964 | Myers | 417/40 X |
| 3,710,612 | 1/1973 | Innes et al. | 73/322.5 |
| 3,867,070 | 2/1975 | Sloan | 417/40 X |
| 4,021,144 | 5/1977 | Matsusaka | 417/40 |

*Primary Examiner*—Carlton R. Croyle
*Assistant Examiner*—Edward Look
*Attorney, Agent, or Firm*—Zachary T. Wobensmith, 2nd; Zachary T. Wobensmith, III

[57] ABSTRACT

Control apparatus is provided responsive to liquid flow which has in the suction line of the pump a float operated magnetically actuated switch in which the float is moved to one position by the presence of liquid attendant on flow and moves to another position upon cessation of flow with provisions including an expansible chamber for impelling the float to the other position either by delivering gas or air to the float chamber or by positively moving the float to the other position. The apparatus is particularly suitable for use in closed systems utilizing supply containers which are collapsed as the liquid is withdrawn.

11 Claims, 4 Drawing Figures

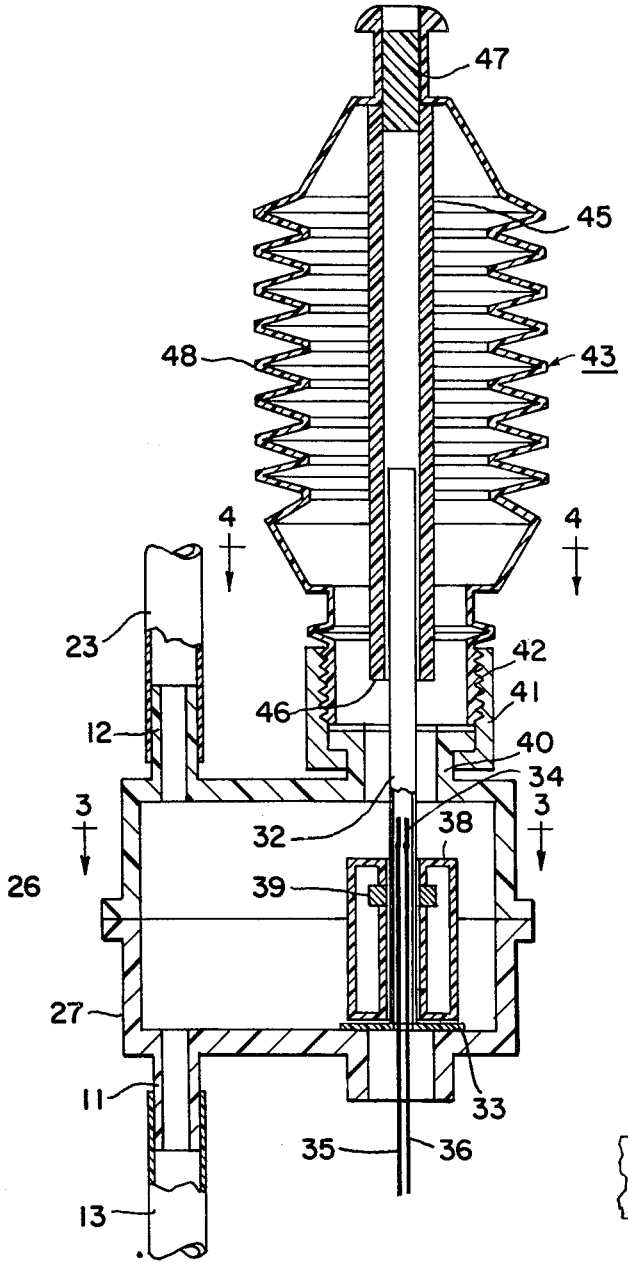
FIG. 2
FIG.4
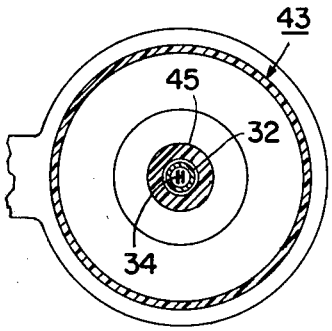
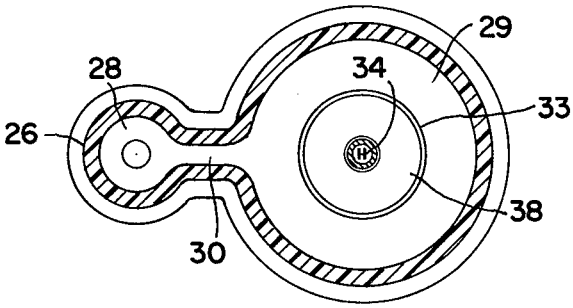
FIG. 3

CONTROL APPARATUS RESPONSIVE TO LIQUID FLOW

BACKGROUND OF THE INVENTION

1. Field of the Invention

This invention relates to control apparatus responsive to liquid flow.

2. Description of the Prior Art

It has heretofore been proposed to provide liquid level responsive devices located in a tank so that when the level in the tank reaches a predetermined low level a control signal is available.

It has also heretofore been proposed to provide pressure responsive switches in a flow line but these have various shortcomings including problems of sealing and packing and lack of quick response to changes in conditions.

Receptacles for liquid chemicals and the like are now frequently employed in which the contents are not intended to be exposed to the air and the receptacle is collapsed as the liquid is withdrawn. The size of such receptacles and their delivery openings does not permit of the insertion of level responsive apparatus into the receptacle. It is also not desired to provide air or gas replacement as the liquid is withdrawn.

It is the principal object of the invention to provide control apparatus responsive to liquid flow which includes a float operated switch with a pressure operated element for moving the float under certain pressure conditions.

It is a further object of the invention to provide control apparatus of the character aforesaid which is particularly suited for use but is not limited for use with a closed liquid system.

It is a further object of the invention to provide control apparatus responsive to liquid flow which comprises a float operated magnetically actuated switch with a pressure controlled override of the buoyant action of the float.

It is a further object of the invention to provide control apparatus responsive to liquid flow which comprises a float operated switch with an expansible chamber providing a control element which chamber acts to equalize pulses from the liquid.

SUMMARY OF THE INVENTION

In accordance with the invention control apparatus is provided particularly suitable for use in a closed liquid system which includes in series a liquid supply receptacle containing a liquid to be transferred, control apparatus, a pump and a receiving receptacle the control apparatus preferably including a float operated magnetically actuated switch in which the float is moved to one position by the presence of liquid attendant upon liquid flow with provisions including an expansible chamber responsive to pressure conditions for impelling the float to another position either by delivering gas or air to the float chamber or by positively moving the float to the other position. The expansible chamber also acts as a stroke equalizer if the pump is a reciprocating pump. The control apparatus is also effective for use in other than closed liquid systems.

It is a further object of the invention to provide control apparatus responsive to liquid flow from a container which can be located as desired and apart from the container.

It is a further object of the invention to provide control apparatus of the character aforesaid which is simple and inexpensive in construction.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which:

FIG. 2 is a vertical central sectional view of the control apparatus of the invention;

FIG. 3 is a horizontal sectional view taken approximately on the line 3—3 of FIG. 2; and FIG. 4 is a horizontal sectional view taken approximately on the line 4—4 of FIG. 2.

Figure 1:
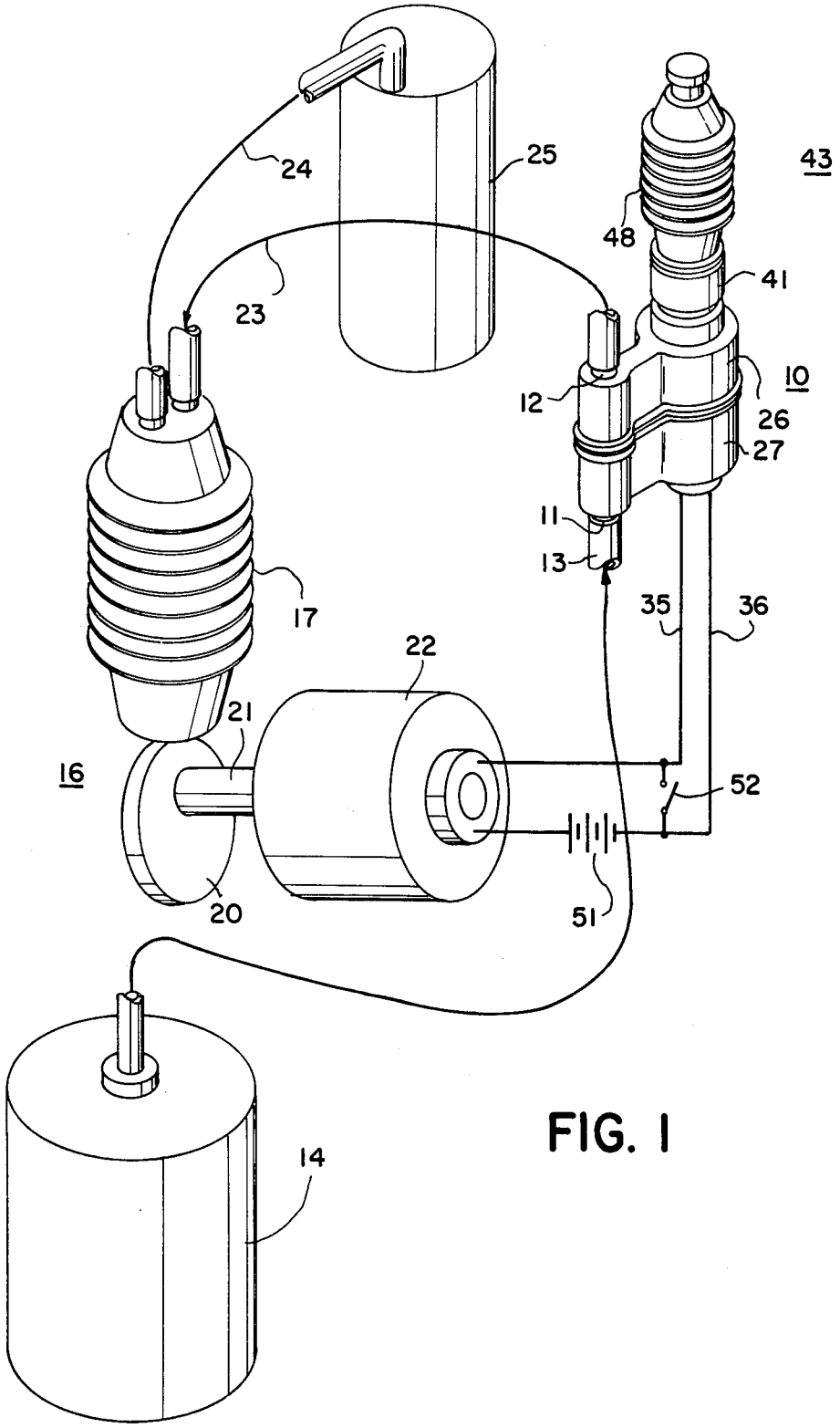
FIG. 1 is a diagrammatic view of the control apparatus of the invention and illustrating one mode of use.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings the control apparatus is shown at 10 and has an inlet connection 11 and a delivery connection 12.

The inlet connection 11 is connected by a pipe 13 to a supply receptacle 14 containing the liquid material to be transferred and whose flow is to be utilized for control purposes. The receptacle 14 can be of any desired type and may be of flexible material which is contracted and collapsed upon withdrawal of the liquid therefrom. A pump 16 is provided of well known type and including an expansible chamber shown as a bellows 17 with inlet and outlet check valves (not shown) and actuated by a cam 20 driven by a motor shaft 21 of an electric motor 22.

The delivery connection 12 is connected by a pipe 23 to the inlet of the pump bellows 17, the outlet of the pump bellows 17 being connected by a pipe 24 to the receiving container or the like 25 to which the liquid is to be delivered.

The control apparatus in a specific embodiment is shown in more detail in FIGS. 2, 3 and 4.

Upper and lower housing sections 26 and 27 are provided, preferably of molded synthetic plastic, and held together in fluid tight relation in any desired manner such as by a suitable adhesive. The housing sections 26 and 27 have a cylindrical chamber portion 28 from the lower end of which the inlet connection 11 extends and from the upper end of which the delivery connection 12 extends.

A float chamber 29 is provided communicating with the chamber 28 by a narrow slot portion 30 which partially isolates the chamber 29 to reduce disturbances therein.

The housing section 27 has extending upwardly from the bottom thereof a tube 32 carried on a closure plate 33 and has in the interior thereof and preferably below the tube of the chamber 29 magnetically operated reed switch contacts 34 from which electric conductors 35 and 36 extend. The tube 32 is closed at the top and serves as a guide for a hollow cylindrical float 38 within which a magnet 39 is mounted for actuating the reed switch contacts 34.

The upper housing section 26 has an upwardly extending neck 40 on which a nut 41 is carried for engagement with threaded lower end 42 of a bellows 43. The bellows 43, in the interior thereof, is provided with a tubular actuator 45 freely slidable on the exterior of the tube 32 and having a lower end face 46 for engagement with the float 38 to move the same downwardly as hereinafter described. The tubular actuator 45 can be secured at the upper end of the bellows 43 in any desired manner, such as by attachment to a plug 47 which is secured in the upper end of the bellows 43.

The bellows 43 has an expansible and contractible continuous cylindrical corrugated side wall portion 48 with alternate ridges and grooves in parallel planes and a frusto-conical lower end portion 49 from which the threaded portion 42 extends.

The conductors 35 and 36 may be utilized to provide a signal dependent upon the position of the float 38 and may if desired be used for actuation of the motor 22 from a source of electrical energy 51. For starting up a switch 52 may be provided.

The mode of operation will now be pointed out.

Upon operation of the pump 17 fluid is drawn upwardly from the receptacle 14 through the pipe 13 into the chamber 28 from which it passes to the chamber 29 through the slot 30. This causes the float 38 to rise so that its magnet 39 can activate the reed switch within the tube 32.

If and when the float 38 has been moved upwardly the switch 52 can be opened to utilize the control action of the control apparatus 10. The pump bellows 17 will have a pulsating effect on the delivery of the liquid from the container 14 to the container 25 and the bellows 43 is effective for smoothing out the pulsating action.

When the receptacle 14 has been collasped so that it can no longer deliver liquid through the pipe 13 the vacuum then made effective within the bellows 43 causes it to contract so that air or gas in the interior of the bellows 43 is delivered downwardly into the chamber 29 which may be sufficient to permit the float 38 to move downwardly because of the lack of buoyant liquid thereabove and therearound.

If this is not effective, upon further contraction of the bellows 43, the tube 45 moves downwardly to a position to engage the float 38 and force the float 38 downwardly to deactivate the magnetic responsive switch contacts 34 which will then shut off power to the motor 22 and discontinue pumping.

If the system is not a sealed system when liquid is no longer delivered by the pump suction no liquid will be effective to raise the float 38 and the float 38 will fall. Motor operation will be discontinued. The control system is accordingly suitable for both sealed and open liquid pumping systems.

The switch contacts 34 are, of course, available for other control functions, if desired.

We claim:

1. Control apparatus responsive to liquid flow comprising a liquid receptacle, a pump connected to said receptacle for withdrawal of liquid therefrom for delivery, and means interposed between said receptacle and said pump and having a portion movably responsive to liquid flow therethrough, said means including electric contact members controlled by said movable portion, and an expansible chamber member for positioning said movable portion under predetermined pressure conditions in said interposed means, and said pump is motor driven and said contct members control the operation of the motor driven pump.

2. Control apparatus as defined in claim 1 in which said movable portion of said interposed means comprises a float responsive to the buoyant effect of pumped liquid, and a member is provided carried by said float for controlling said contact members.

3. Control apparatus as defined in claim 2 in which said expansible chamber member is in communication with the space above said float for gas delivery to lower said float.

4. Control apparatus as defined in claim 2 in which said expansible chamber has a member engageable with said float for moving the same downwardly upon predetermined contraction of said expansible chamber.

5. Control apparatus as defined in claim 1 in which said interposed means includes a tubular portion, and said float is guided by said tubular portion.

6. Control apparatus as defined in claim 1 in which said interposed means includes a chamber to which said pump is connected and to which said liquid receptacle is connected for liquid flow therethrough, and an additional chamber is provided in communication with said first chamber in which said movable portion is disposed.

7. Control apparatus as defined in claim 1 in which said expansible chamber is an expansible and contractible bellows.

8. Control apparatus responsive to liquid flow comprising a housing having fluid inlet and delivery connections, a float member within said housing responsive to the presence of fluid in said housing, electric contact members controlled by said float, and an expansible chamber member in communication with the interior of said housing for controlling said float, and control means controlled by said electric contact members.

9. Control apparatus as defined in claim 8 in which said housing has a chamber within which said float member is disposed spaced from said inlet and delivery connections.

10. Control apparatus as defined in claim 9 in which said expansible chamber member has a member moved thereby for engagement with said float for positioning said float.

11. Control apparatus as defined in claim 8 in which said expansible chamber member is an expansible and contractible bellows.

* * * * *